United States Patent [19]

Southland

[11] Patent Number: 4,852,671

[45] Date of Patent: Aug. 1, 1989

[54] DIAMOND CUTTING ELEMENT

[75] Inventor: Stephen G. Southland, Houston, Tex.

[73] Assignee: Diamant Boart-Stratabit (USA) Inc., Houston, Tex.

[21] Appl. No.: 26,962

[22] Filed: Mar. 17, 1987

[51] Int. Cl.[4] ..... E21B 10/46; E21B 10/60

[52] U.S. Cl. ..... 175/329; 175/393; 175/410

[58] Field of Search ..... 175/329, 330, 393, 410; 299/81

[56] References Cited

U.S. PATENT DOCUMENTS

| | | | |
|---|---|---|---|
| 1,756,450 | 4/1930 | Black . | |
| 1,899,458 | 2/1933 | Erickson . | |
| 1,923,488 | 8/1933 | Howard et al. | 175/410 |
| 4,221,270 | 9/1980 | Vezirian | 175/329 |
| 4,303,136 | 12/1981 | Ball | 175/329 |
| 4,452,324 | 6/1984 | Jurgens | 175/393 |
| 4,499,958 | 2/1985 | Radtke et al. | 175/329 |
| 4,515,002 | 5/1985 | Groethe | 72/339 |
| 4,606,418 | 8/1986 | Thompson | 175/329 |

FOREIGN PATENT DOCUMENTS

| | | | |
|---|---|---|---|
| 308189 | 8/1971 | U.S.S.R. | 175/393 |
| 495437 | 3/1976 | U.S.S.R. | 299/81 |
| 907214 | 2/1982 | U.S.S.R. | 175/393 |
| 980799 | 1/1965 | United Kingdom | 175/329 |

*Primary Examiner*—Hoang C. Dang

*Attorney, Agent, or Firm*—Burns, Doane, Swecker & Mathis

[57] ABSTRACT

A rotary drill bit contains a plurality of cutting elements. Each cutting element includes a stud and a cutting disk mounted on the stud. The cutting disk comprises a substrate and a diamond layer bonded to the substrate. The cutting disk comprises a relief formed in an outer peripheral edge of the substrate and diamond layer at a formation-contacting point of the diamond layer, to form a pair of cutting points separated by the relief. The stud includes a channel aligned with the relief for conducting fluid to the relief to cool and clean the cutting points. The stud may include a fluid passage for conducting drilling fluid directly to the channel.

18 Claims, 2 Drawing Sheets

DIAMOND CUTTING ELEMENT

BACKGROUND OF THE INVENTION

The present invention relates to cutting elements of the type which are mounted on rotary drill bits for cutting through earth formations (including rock formations), cement, plugs, etc.

Rotary drilling operations in earth formations are typically carried out using a rotary drill bit which is simultaneously rotated and advanced into the formation. Cutting is performed by cutting elements mounted on the drill bit, and the cuttings are flushed to the top of the bore hole by the circulation of drilling fluid.

A conventional cutting element may comprise a cutting blank mounted on a cemented carbide stud. The blank may include a diamond disk disposed on a carbide substrate. The blank can be braze bonded to an inclined face of the stud, and the stud is then secured, e.g., by press-fit in a recess of the drill bit. Cutting elements of this type are disclosed, for example, in U.S. Pat. No. 4,499,958.

During the use of cutting elements of this type, cutting takes place by means of a section of the peripheral edge of the blank which is brought into contact with the formation being cut.

In the cutting of relatively soft formations, cutting elements with a large cutting area is preferred, whereas cutting elements with a smaller cutting area, e.g., so-called "chisel" cutters, are preferred for cutting harder formations so that the cutting forces can be more concentrated.

Among the problems faced by diamond cutting elements is the deterioration resulting from friction-generated heat. In practice, attempts are made to reduce the temperature of the cutting elements by directing drilling fluid in the vicinity of the cutting elements. It is difficult, however, to apply that fluid directly on the segments of the cutting elements which actually perform the cutting function. Chisel-type cutters are particularly susceptible to thermal deterioration because the cutting action is concentrated on a smaller working area (i.e., so-called point loading) which intensifies the heat build-up in the working area of the diamond.

It would be desirable to reduce the heat build-ups on diamond cutting elements and also increase the rate of formation penetration

SUMMARY OF THE INVENTION

The present invention involves a cutting element for use in a drill bit. The cutting element comprises a cutting disk. The cutting disk comprises a substrate and a diamond substance bonded to the substrate. The cutting disk comprises a relief formed in an outer peripheral edge of the substrate and diamond substance at a formation-contacting point of the diamond substance, to form a pair of cutting points separated by the relief.

Preferably, the substrate is bonded to a stud. The stud includes a channel aligned with the relief for conducting fluid to the relief to cool and clean the cutting points.

Preferably, the stud includes a passage extending end-to-end therethrough and exiting in the channel. Cooling fluid can be conducted from the bit body to the passage and then conducted directly to the channel.

The passage may extend parallel to a longitudinal axis of the stud, or it may be inclined toward the cutting disk.

A secondary passage may be formed in the stud to conduct drilling fluid directly to a rear side of the substrate.

The present invention also contemplates the combination of a rotary drill bit containing the above-described cutting elements.

BRIEF DESCRIPTION OF THE DRAWING

The advantages of the invention will become apparent from the following detailed description of preferred embodiments thereof, in connection with the accompanying drawings, in which like numerals designate like elements, and in which.

DETAILED DESCRIPTION OF PREFERRED EMBODIMENTS OF THE INVENTION

Figure 8:
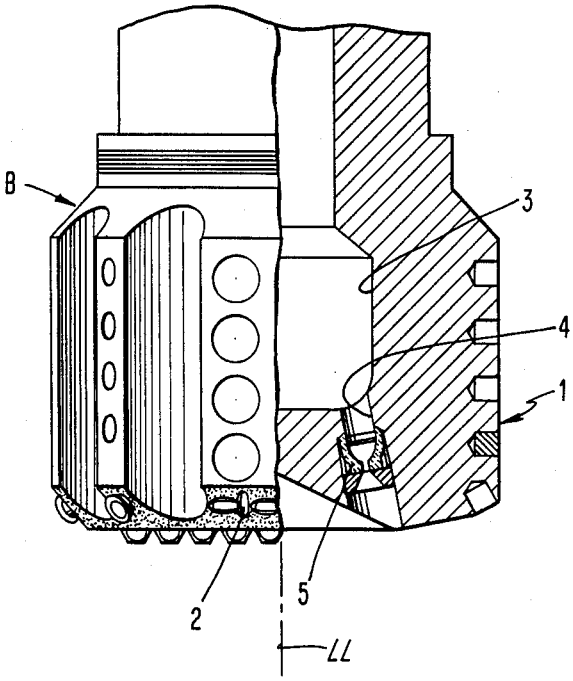
FIG. 8 is a side elevational view of a drill bit body, with a portion thereof broken away, the drill bit body carrying cutting elements according to the present invention.

Depicted in FIG. 8 is a drill bit B including a bit body, which carries a plurality of diamond cutting elements 2 on a front cutting face thereof. The drill bit cuts a formation when rotated about a front-to-rear extending axis LL. The cutting elements are cleaned and cooled by means of cooling fluid in the form of drilling mud which is conducted downwardly through an internal conduit 3 in the drill bit body, into bores 4 of the drill bit, and outwardly through nozzles 5 mounted in the bores 4 (only one bore and nozzle being depicted).

Figure 1:
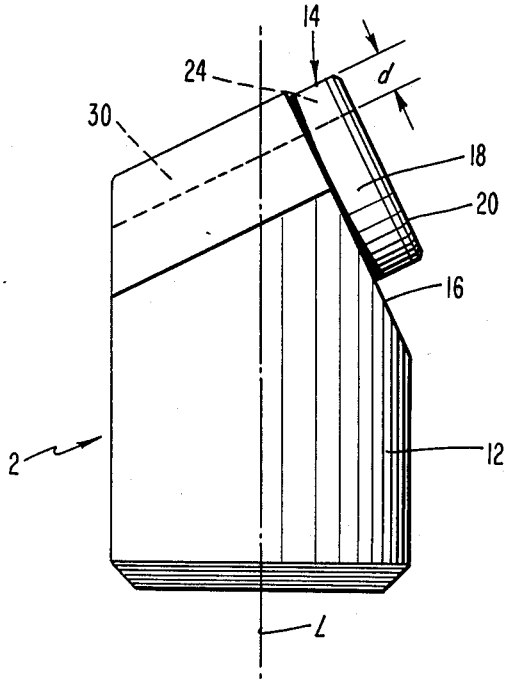
FIG. 1 is a side elevational view of a cutting element according to the present invention.
Figure 2:
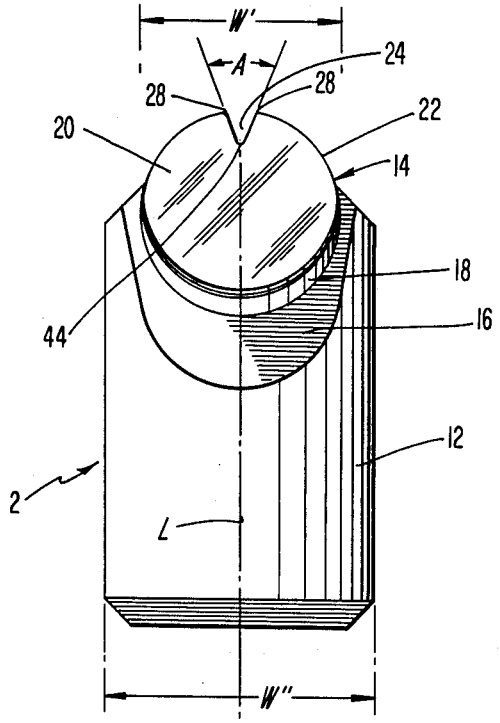
FIG. 2 is a front elevational view of the cutting element depicted in FIG. 1.

A diamond cutting element 2 according to one preferred embodiment of the present invention is depicted in FIGS. 1 and 2. That cutting element 10 includes a cylindrical stud 12, preferably formed of a cemented carbide such as cemented tungsten carbide, and a cutting disk 14 bonded to an inclined front face 16 of the stud 12. The cutting disk 14 comprises a substrate 18 to which a diamond layer 20 is adhered, which layer defines a cutting face. The substrate 18 is preferably formed of a cemented carbide, such as cemented tungsten carbide, and is brazed to the inclined face 16 of the stud.

The diamond layer preferably comprises a polycrystalline diamond layer which is sintered to an outer face of the substrate. The outer peripheral edge 22 of the front cutting face of the diamond layer is chamfered to reduce chipping thereof during cutting operations.

In accordance with the present invention, a relief or recess 24 is provided through the cutting disk at a formation-contacting zone thereof, i.e., at the leading or forwardmost end of the peripheral edge 22 where engagement of the cutting element with the formation occurs. The relief 24 forms that leading end with a pair of cutting points 28 separated by the relief 24. During a cutting operation, the cutting forces are concentrated at the two points 28 which define cutting segments of shorter width than the cutting edge segment of a typical chisel-type cutting element. Therefore, less friction is generated, resulting in cooler operation.

Although the disk could be mounted directly on a drill bit, it is preferably mounted on the stud such that the relief 24 is aligned with a similar relief 30 formed in the leading end of the stud 12. The relief 30 forms a channel adapted to conduct cooling fluid (i.e., drilling mud) to the disk relief 24, whereby the fluid travels in intimate contact with the cutting points to clean and cool same. The channel 30 can extend completely across the leading end of the stud, or partially thereacross. The latter is of particular utility when employed in conjunction with the embodiments of FIGS. 3–7.

Figure 3:
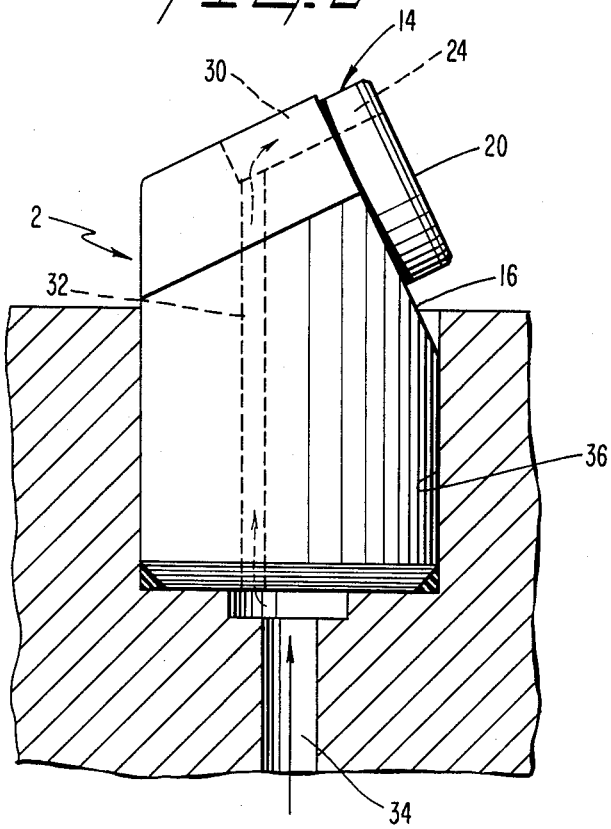
FIG. 3 is a sectional view taken through a drill bit body depicting in side elevation a cutting element similar to that depicted in FIG. 1, and further including a fluid conducting passage therein.
Figure 4:
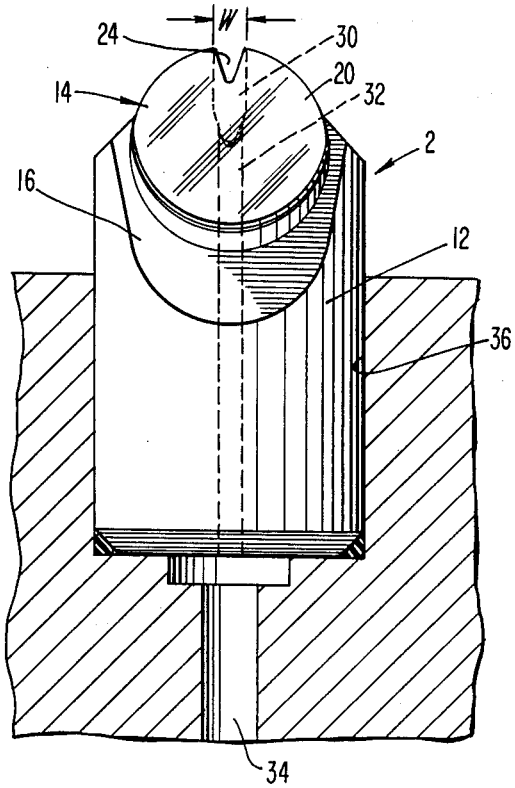
FIG. 4 is a front elevational view of the cutting element depicted in FIG. 3.

In FIG. 3, there is depicted a stud having a fluid passage 32 extending end-to-end through the stud. The passage 32 communicates with the stud relief 30 behind the cutting disk 14 to deliver cooling fluid directly to the stud relief 30. The fluid passage 32 extends parallel to the stud longitudinal axis L and is supplied with drilling fluid by a conduit 34 which is formed in the drill bit body and exits into the bore 36 in which the stud 12 is mounted (e.g., mounted by brazing or friction-fit). That conduit 34 receives cooling fluid from the main cooling conduit 3 extending through the drill bit. Fluid traveling from the passage 32 and into the stud relief 30 travels forwardly through the disk relief 24 to clean and cool the cutting points 28.

Figure 5:
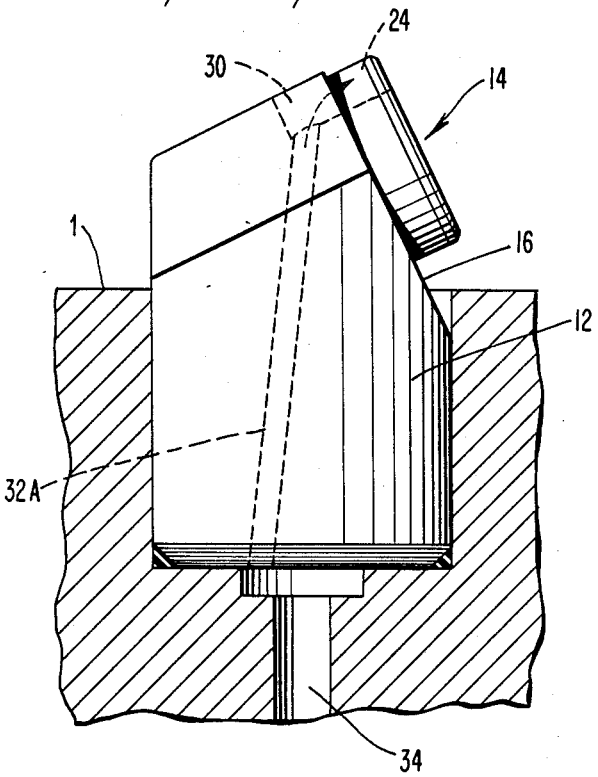
FIG. 5 is a view similar to FIG. 3, wherein the passage in the stud is inclined relative to a longitudinal axis of the stud.

Preferably, the passage 32A is inclined toward the cutting disk 14 (FIG. 5).

Figure 6:
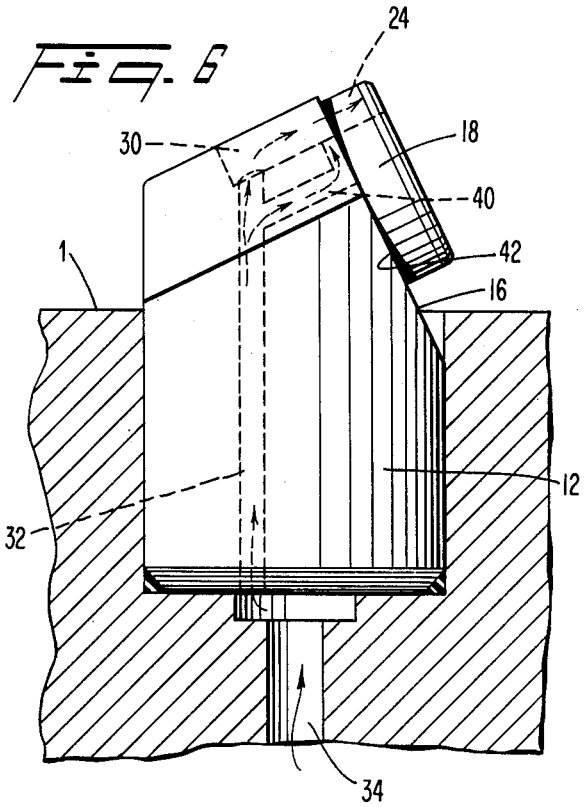
FIG. 6 is a view similar to FIG. 3 of an alternative passage, arrangement within the stud.
Figure 7:
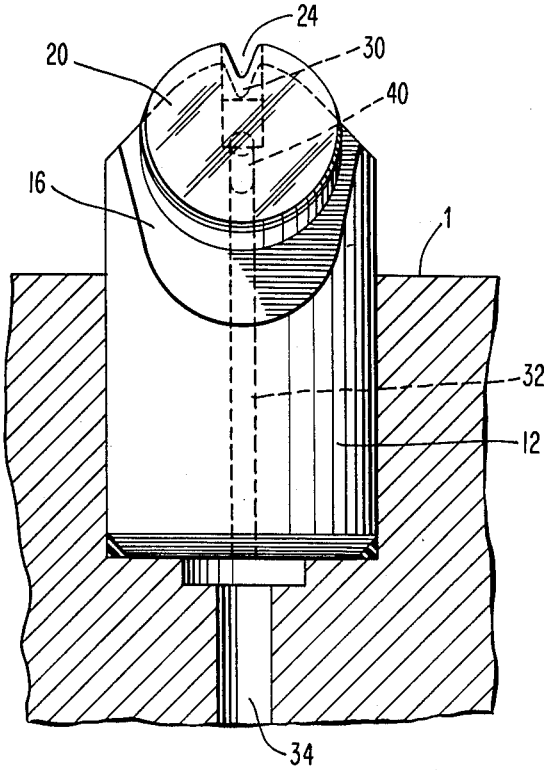
FIG. 7 is a front elevational view of the cutting element depicted in FIG. 6.

Depicted in FIGS. 6 and 7 is a secondary passage 40 which extends from the primary passage 32 at a location intermediate the ends of the primary passage, to a location directly behind, and in contact with, the rear surface 42 of the substrate 18. The secondary passage 40 continues forwardly to merge with the stud relief 30 at the point of its intersection with the disk relief 24.

It will be appreciated that the cooling of the substrate is more effective, due to the direct contact between the back surface 42 of the substrate and the fluid flowing through the secondary passage 40.

The disk relief 24 is preferably V-shaped, defining an inclined angle A of 40 degrees. The depth d of the relief 24 need not be very long, e.g., about 0.25 inch on a 0.75 inch diameter diamond layer. On a 0.524 inch diameter layer a relief of about 0.175 inch depth could be provided. The bottom 44 of the relief 24 can be non-radiused, or radiused, e.g., a radius of 0.0624 inch on a 0.75 inch diameter diamond layer.

The present invention is suitable for use with any type of stud, e.g., a stud whose longitudinal axis is aligned with the axis of the disk. Thus, such a stud would be provided with a channel aligned with a relief formed in the disk.

It will be appreciated that the presence of a relief 24 in the cutting disk creates two spaced cutting points as opposed to a single extended cutting edge in a chisel-type cutting element. Thus, the total area of surface contact between the diamond layer and the formation is reduced, whereby the resulting amount of frictional heat is also reduced. By reducing the amount of heat, the rate of thermally-induced deterioration of the diamond is reduced. In addition, the cutting action of the spaced points creates a faster penetration into the formation. The relief also serve to conduct drilling fluid into intimate contact with the cutting points and the rest of the diamond layer for an improved cooling and cleaning action. This is especially true in cases where drilling fluid is conducted through the stud.

A relatively wide cutting width W, i.e., the distance from point to point, is achieved as the result of a relatively small amount of penetration of the disk into the formation being cut, e.g., a chisel type cutter would require a much deeper penetration to achieve a similar cutting width. That width W of the recess 24 is smaller than the width W′ of the cutting face 20 and smaller still than the width W″ of the stud 12. The recess 24 is bisected by a plane which contains the axis L and is oriented perpendicular to the paper in FIG. 2.

In addition, the size of the relief is small as compared to the amount of material which is eliminated from the cutting disk to form a chisel shape. Thus, the area of bonding contact between the substrate and the stud is not significantly reduced in a cutting element according to the present invention.

The cutting element according to the present invention has particular utility in the cutting of hard formations, i.e., has utility as a replacement for chisel-type cutters.

Although the present invention has been described in connection with preferred embodiments thereof, it will be appreciated by those skilled in the art that additions, modifications, substitutions, and deletions not specifically described, may be made without departing from the spirit and scope of the invention as defined in the appended claims.

I claim:

1. A cutting element for use on a rotary drill bit, said cutting element comprising a cylindrical stud and a cutting disk bonded to said stud, said stud defining a longitudinal axis and including a forwardly facing front face, said cutting disk including a substrate and a diamond substance bonded to one surface of said substrate to define a forwardly facing cutting face, said diamond cutting face having a width no greater than a width of said stud, another surface of said substrate being bonded to said front face of said stud, said diamond cutting face including an outer peripheral edge and arranged such that a portion of said outer peripheral edge is disposed forwardly of the remaining portion of said peripheral edge to define a formation-contacting zone, a rearwardly extending recess disposed in said formation-contacting zone of said edge to form therein a pair of cutting points separated by said recess, said recess being of smaller width than both said cutting face and said stud, said recess being bisected by a plane containing said longitudinal axis and disposed equidistantly from said cutting points.

2. A cutting element according to claim 1, wherein said stud includes a channel aligned with said recess for conducting fluid to said recess to cool and clean said cutting points.

3. A cutting element according to claim 2, wherein said stud includes a passage extending end-to-end therethrough and exiting in said channel.

4. A cutting element according to claim 3, wherein said passage extends parallel to a longitudinal axis of said stud.

5. A cutting element according to claim 3, wherein said passage is inclined toward said cutting disk.

6. A cutting element according to claim 3 including a secondary passage formed in said stud to communicate with said first-named passage at a location intermediate the ends thereof and extends to a back surface of said substrate and then along the back surface until terminating at said channel at the intersection of said channel and said recess.

7. A cutting element according to claim 1, wherein said recess is V-shaped.

8. A cutting element according to claim 7, wherein said V-shaped recess includes an angle of about 40 degrees.

9. A rotary drill bit comprising:

a drill bit body rotatable about a front-to-rear extending axis and having a front surface and a plurality of cutting elements mounted in said surface for cutting a formation as said bit body is rotated about said axis, each cutting element comprising a cylindrical stud and a cutting disk bonded to said stud, said stud defining a longitudinal axis and including a forwardly facing front face, said cutting disk including a substrate and a diamond substance bonded to one surface of said substrate to define a forwardly facing cutting face, said diamond cutting face having a width no greater than a width of said stud, another surface of said substrate being bonded to said front face of said stud, said diamond cutting face including an outer peripheral edge and arranged such that a portion of said outer peripheral edge is disposed forwardly of the remaining portion of said peripheral edge to define a formation-contacting zone, a rearwardly extending recess disposed in said formation-contacting zone of said edge to form therein a pair of cutting points separated by said recess, said recess being of smaller width than both said cutting face and said stud, said recess being bisected by a plane containing said longitudinal axis and disposed equidistantly from said cutting points.

10. A rotary drill bit according to claim 9 including a conduit in said bit body for conducting drilling fluid, nozzle means mounted in said bit body and communicating with said conduit for ejecting drilling fluid forwardly of said bit body, said stud including a channel aligned with said recess for conducting drilling fluid to said recess to cool and clean said cutting points.

11. A drill bit according to claim 10, wherein said stud includes a passage extending end-to-end therethrough and exiting in said channel, said passage communicating with said conduit in said bit body for conducting drilling fluid to said channel.

12. A drill bit according to claim 11, wherein said passage extends parallel to a longitudinal axis of said stud.

13. A drill bit according to claim 11, wherein said passage is inclined toward said cutting disk.

14. A drill bit according to claim 11 including a secondary passage formed in said stud to communicate with said first-named passage at a location intermediate the ends thereof and extends to a back surface of said substrate and then along said back surface until terminating at said channel at the intersection of said channel and said recess.

15. A drill bit according to claim 9, wherein said recess is V-shaped.

16. A drill bit according to claim 15, wherein said V-shaped recess includes an angle of about 40 degrees.

17. A cutting element for use on a rotary drill bit, said cutting element comprising a stud and a cutting disk bonded to said stud, said stud defining a longitudinal axis and including a longitudinal front face, said cutting disk including a substrate and a diamond substance bonded to one surface of said substrate, another surface of said substrate being bonded to said front face of said stud, said disk including an outer peripheral edge and arranged such that a portion of said outer peripheral edge is disposed forwardly of the remaining portion of said peripheral edge to define a formation-contacting zone, a rearwardly extending recess disposed in said formation-contacting zone of said edge to form therein a pair of cutting points separated by said recess, a stud to which said substrate is bonded, said stud including a channel aligned with said relief for conducting fluid to said relief to cool and clean said cutting points, said stud including a passage extending end-to-end therethrough and exiting in said channel.

18. A rotary drill bit comprising a drill bit body rotatable about a front-to-rear extending axis and having a front face and a plurality of cutting elements mounted in said face for cutting a formation as said bit body is rotated about said axis, each cutting element comprising a cutting disk including a substrate and a diamond substance bonded to said substrate, said cutting disk including an outer peripheral edge, and arranged such that a portion of said outer peripheral edge is disposed forwardly of the remaining portion of said edge to define a formation-contacting zone, a rearwardly extending recess disposed in said formation-contacting zone of said outer peripheral edge to form therein a pair of cutting points separated by said recess, a conduit disposed in said bit body for conducting drilling fluid, nozzle means mounted in said bit body and communicating with said inner passage for ejecting drilling fluid forwardly of said bit body, each said cutting element including a stud to which said substrate is bonded, said stud including a channel aligned with said recess for conducting drilling fluid to said recess to cool and clean said cutting points, said stud including a passage extending end-to-end therethrough and exiting in said channel, said passage communicating with said conduit in said bit body for conducting drilling fluid to said channel.

* * * * *